US007290335B2

(12) United States Patent
Zielke

(10) Patent No.: US 7,290,335 B2
(45) Date of Patent: Nov. 6, 2007

(54) DRIVE CHAIN ASSEMBLY RESTRAINT

(75) Inventor: Martin R. Zielke, Lockport, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 185 days.

(21) Appl. No.: 10/870,171

(22) Filed: Jun. 17, 2004

(65) Prior Publication Data

US 2005/0278948 A1 Dec. 22, 2005

(51) Int. Cl.
*B21K 3/00* (2006.01)

(52) U.S. Cl. ..... 29/888.01

(58) Field of Classification Search ..... 29/888.01, 29/888.1, 888.011, 888.012, 434
See application file for complete search history.

(56) References Cited

U.S. PATENT DOCUMENTS

| | | | | |
|---|---|---|---|---|
| 6,047,942 | A * | 4/2000 | Kennedy | 248/674 |
| 6,205,960 | B1 * | 3/2001 | Vallejos | 123/44 R |
| 6,234,127 | B1 * | 5/2001 | Simpson et al. | 123/90.31 |
| 2002/0023616 | A1 * | 2/2002 | Stone | 123/198 R |

* cited by examiner

*Primary Examiner*—John C. Hong
(74) *Attorney, Agent, or Firm*—Jeffrey P. Calfa; Gerald W. Askew

(57) ABSTRACT

An apparatus for and method of installing a drive chain (201) uses one or more restraints (101) that do not interfere with drive chain function in an operating engine nor fall off during installation. One or more restraints (101) near a sprocket (207) attached to the crankshaft or other device facilitate installation of one or more drive chains (201) during engine assembly by limiting the movement of the drive chain (201) away from the sprocket (207).

5 Claims, 2 Drawing Sheets

DRIVE CHAIN ASSEMBLY RESTRAINT

FIELD OF THE INVENTION

The present invention relates to engines, including, but not limited to, methods of assembling internal combustion engines.

BACKGROUND OF INVENTION

Devices and methods for assembling internal combustion engines, particularly for the installation of a drive chain on a crankshaft and a camshaft of a diesel engine, are known. One such method, by example, is as follows. The drive chain is placed on a crankshaft sprocket while the engine block is in an inverted position. The oil pump and the oil pan are then installed, but limit access to the crankshaft sprocket. The engine is rotated to an upright position to assemble its cylinder head(s) to the engine and to install the drive chain on a camshaft sprocket. During rotation of the engine, the drive chain may fall off the crankshaft sprocket and become lodged in the engine. Recovery and reinstallation of the drive chain may be time consuming and tedious, potentially requiring removal of installed parts, such as the oil pan and the oil pump. In addition, drive chain recovery may be complicated by compact engine designs, such as those designs having an engine block with an integral drive chain case. For engines with an integral drive chain, the drive chain is typically fed through the case from the bottom of the engine. Thus, reinstallation of the drive chain may also require rotating the engine upside down.

Tools may be used to hold the drive chain in place during engine assembly, particularly during engine rotation. Because tools may interfere with drive chain operation, tools are typically utilized and/or installed temporarily. Installation and removal of the tool may be time consuming. During their use, the tools may be dropped into the engine assembly or may become dislodged and fall into the engine. In addition, once the tool is dislodged, the chain may fall such that possibly both the tool and the drive chain may become caught in the engine. Loss of both the tool and the drive chain may require time consuming recovery and rework of the partially assembled engine.

Accordingly, there is a need for a method of assembling a drive chain that does not suffer from the risk of the drive chain or a tool becoming caught in the engine.

SUMMARY OF INVENTION

An apparatus comprises at least one restraint mounted to a first engine component. The at least one restraint is disposed near an outer perimeter of at least one sprocket attached to a second engine component. The at least one restraint is capable of engaging a drive chain between the at least one sprocket and the restraint to prevent the drive chain from dislodging from the at least one sprocket while allowing the drive chain to move freely during engine operation.

DESCRIPTION OF A PREFERRED EMBODIMENT

The following describes an apparatus for and method of installing a drive chain using one or more restraints that do not interfere with drive chain function in an operating engine nor fall off during installation. One or more restraints near a sprocket attached to the crankshaft facilitate installation of one or more drive chains during engine assembly by limiting the movement of the drive chain away from the sprocket.

Figure 1:
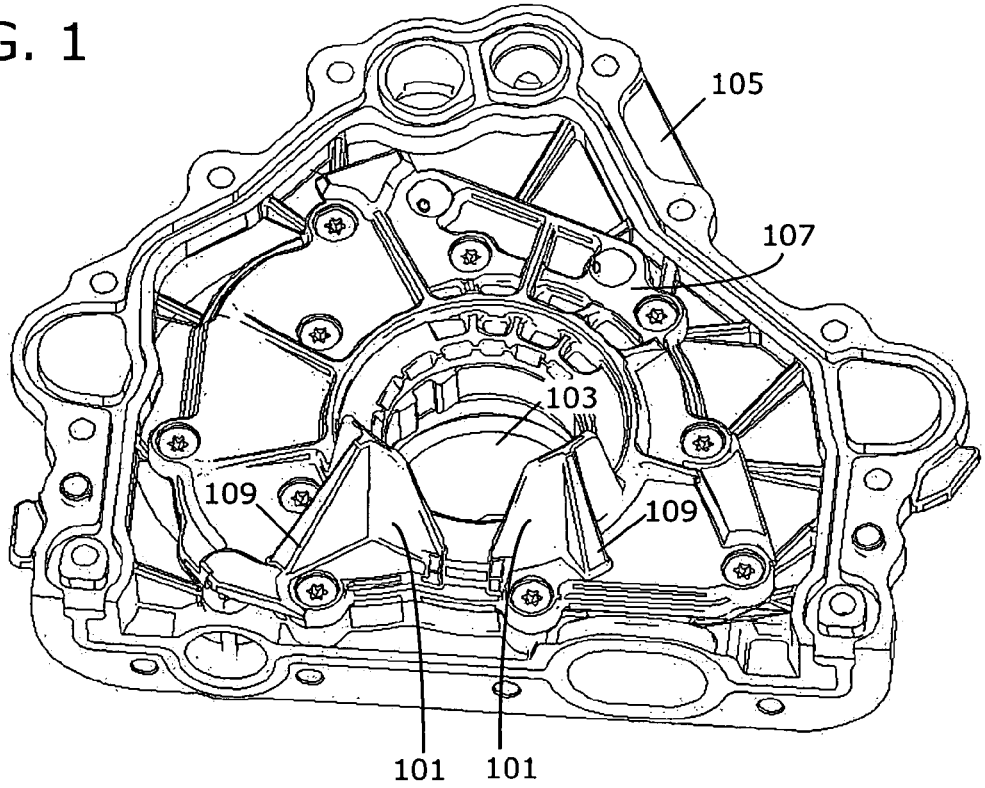
FIG. 1 illustrates drive chain restraints mounted on an oil pump of an engine in accordance with the invention.

Drive chain restraints 101 mounted on an engine component are shown in FIG. 1. The drive chain restraints 101 are shown attached adjacent to an opening 103 in an oil pump 105. One or more drive chain restraints 101 are advantageously attached to a backplate 107 of the oil pump 105. The restraints 101 may be cast integrally as part of the backplate 107 or housing of the oil pump 105. Alternatively, the restraints 101 may be separate items, formed from sheet metal, molded plastic, and so forth and attached to the backplate 107. The restraints 101 are attached close to the opening 103. The restraint 101 may advantageously include a support 109 that provides additional support and strength. The support 109 may be integral to or attached to the restraint 101 on the opposite side of the restraint 101 as the opening 103.

Figure 2:
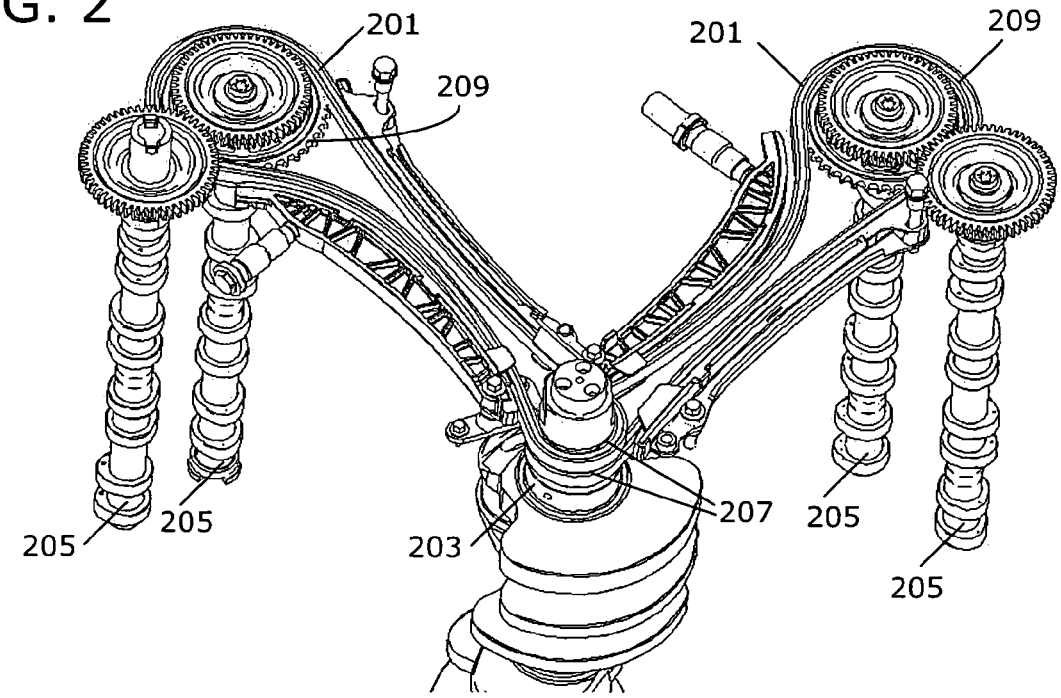
FIG. 2 illustrates drive chains that are operably connected to the crankshaft and a camshaft in accordance with the invention.

Drive chains 201 operably connected to a crankshaft 203 and a camshaft 205 are shown in FIG. 2. Two separate drive chains 201 engage two separate crankshaft sprockets 207 that are operably attached to the crankshaft 203. The drive chains 201 also engage two separate camshaft sprockets 209 that are operably attached to one or more camshafts 205. Alternatively, the drive chains 201 may be installed on sprockets attached to drive shafts and/or other drive mechanisms, so as to drive other engine systems, such as a coolant system, an air conditioning system, and so forth. Typically, the crankshaft sprockets 207 and the camshaft sprockets 209 have a plurality of teeth that engage the drive chains 201. Although chain driven sprockets 207 and 209 with teeth are shown to drive the camshafts, toothless sprockets, such as a wheels or a pulleys, driven by belts or chains formed to operate as belts, may alternatively be used to drive the camshafts.

Figure 3:
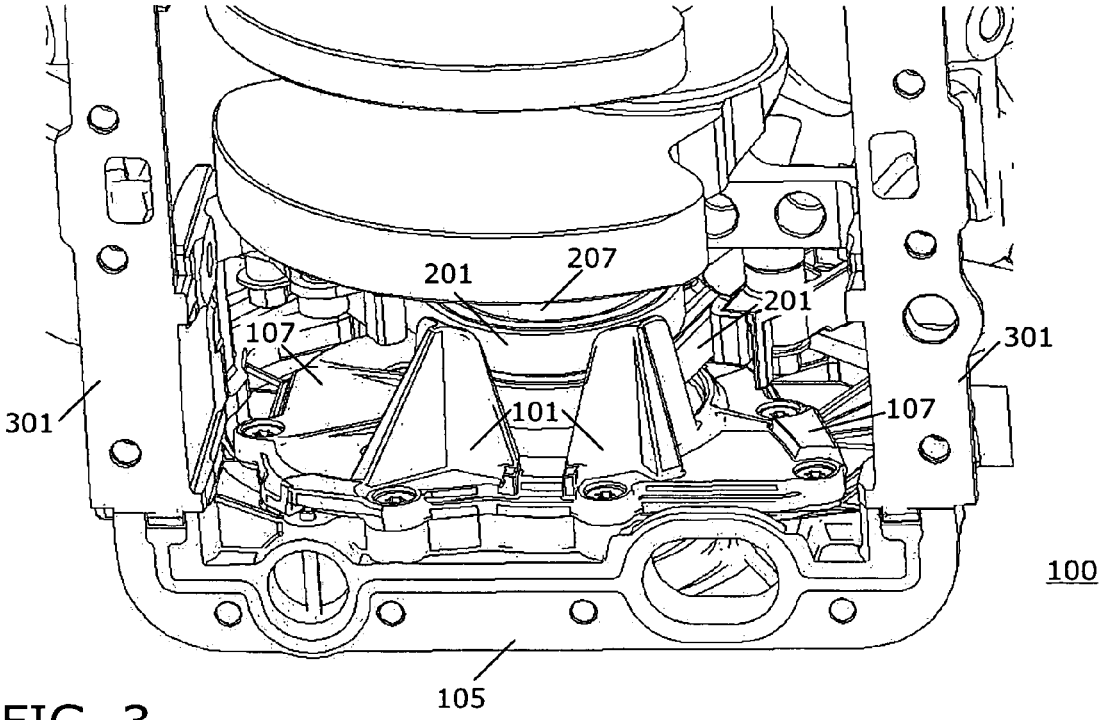
FIG. 3 illustrates drive chains and restraints assembled in the engine in accordance with the invention.

Drive chains 201 and restraints 101 are shown assembled in the engine in FIG. 3. The crankshaft 203 is mounted, as known in the art, in the engine block 301. The oil pump 105 attaches to the engine block 301. The oil pump 105 of FIG. 3 is driven by the crankshaft 203. The crankshaft 203 passes through the opening 103 in the oil pump 105 and associated backplate 107 and engages the oil pump 105 for operation. One or more restraints 101 extend away from the backplate 107 so that a portion of the restraint 101 is near an outer perimeter of one or more crankshaft sprockets 207. The restraints 101 are attached to the backplate close enough to the outer perimeter of the crankshaft sprockets 207 to limit drive chain 201 movement during engine assembly, but not close enough to interfere with the drive chain 201 when the engine is operating, such that the drive chains 201 move freely along the crankshaft sprockets 207 during engine operation. Advantageously, the drive chains 201 do not make contact with the restraints 101 during engine operation. When the crankshaft sprockets 207 have teeth, the distance between the teeth and the restraints 101 limits movement of the drive chain(s) 201 relative to the sprocket(s) 207 such that the drive chain(s) 201 is engaged with the sprocket(s) 207. Alternatively, the restraints 101 may be attached to an oil cover, an oil pan, and/or other engine components that are near the sprockets and drive chains 201.

Figure 4:
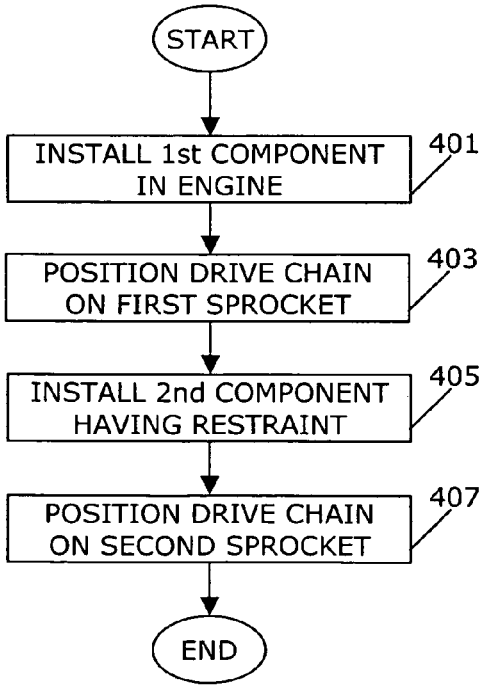
FIG. 4 is a flowchart illustrating a method of installing a drive chain in accordance with the invention.

A flowchart illustrating a method of installing a drive chain 201 is shown in FIG. 4. At step 401, the crankshaft 203 is installed into the engine block. To facilitate installation of the crankshaft and the drive chains 201, the engine is advantageously in an inverted position. At step 403, one or more drive chains 201 are positioned on and engage one or more crankshaft sprockets 207. For an engine in an inverted position, gravity may hold the drive chains 201 in a desired position with respect to the crankshaft sprockets 207. If the engine is upright, the drive chains 201 may be held in position mechanically. For example, sections of the drive chain 201 may be tied together with rope or wire.

At step 405, the oil pump 105 is mounted to the engine by passing the crankshaft 203 into the opening 103 until the oil pump 105 is engaged. Simultaneously, and while the drive chains 201 are held in position, the restraints 101 are moved into position near the crankshaft sprockets 207 as the oil pump 105 is attached to the engine block 301.

At step 407, the drive chains 201 are positioned on one or more camshaft sprockets 209. Cylinder head(s) may then be attached to the engine block 301. Typically, the engine is in an inverted position and is rotated to an upright position before the cylinder head(s) are attached to the engine block 301 and the of the drive chains 201 are attached to the camshaft sprockets 209. The restraints 101 limit drive chain 201 movement sufficiently to virtually eliminate the potential for drive chains 201 falling off the crankshaft sprockets 207 during engine rotation. Other engine components may be installed on the engine at any time during this process, and the drive chains 201 may be attached to other devices. During rotation of the engine, the restraints 101 limit drive chain 201 movement relative to the crankshaft sprockets 207 such that the drive chains 201 remain engaged with and do not fall off the crankshaft sprockets 207. Similarly, for engines assembled in an upright position, the restraints 101 may limit drive chain 201 movement relative to the crankshaft sprocket 207 when the mechanical device that holds the drive chains 201 in position is removed.

Although the present invention is illustrated by the example of two drive chains where each drive chain is mounted on separate crankshaft and camshaft sprockets of an internal combustion engine such as a diesel engine, the present invention may be applied to: engines having one or more drive chains connected to the crankshaft sprocket and having a plurality of cylinders, including those with less than, equal to, or greater than six cylinders; various engine types, such as in-line, V type, and so forth; engines having different cylinder firing orders; diesel engines, gasoline engines, or other types of engines; turbocharged and non-turbocharged engines; engines of any size; and engines having drive chains that are connected to and drive one or more sprockets that deliver power to mechanisms such as camshafts and/or other engine systems.

The present invention may be utilized to install devices that deliver power from one shaft to another. For example, advantage may be gained in the installation of one or more belts during assembly of various types of motors, engines, machines, and so forth, such as when a drive belt is installed on a plurality of pulleys, and the drive belt has the potential of falling off during further assembly after initially being positioned on at least one pulley.

The present invention provides a number of advantages. The potential for a drive chain falling off a sprocket during engine manufacture is reduced. The restraint(s) limit drive chain movement during engine construction, yet do not interfere with drive chain operation when the engine is operating. Restraining the drive chain from disengaging from a sprocket provides a more efficient manufacturing process that involves positioning the engine in an inverted position and rotating the engine to an upright position. The need to install and remove temporary mechanical devices to hold drive chains in position is eliminated. The time and cost associated with retrieving and reinstalling drive chains that fall off during engine assembly is eliminated. Thus, the cost to manufacture an engine is reduced.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A drive chain assembly restraint, comprising at least one restraint mounted to a first engine component, wherein the at least one restraints disposed near an outer perimeter of at least one sprocket attached to a second engine component, wherein the at least one restraint is capable of engaging a drive chain between the at least one sprocket and the restraint to prevent the drive chain from dislodging from the at least one sprocket while allowing the drive chain to move freely during engine operation, and wherein a distance between the outer perimeter of the at least one sprocket and the restraint limits movement of the drive chain relative to the sprocket such that the drive chain is engaged with the sprocket, and wherein the drive chain moves past the at least one restraint without contact when the engine is operating.

2. A drive chain assembly restraint, comprising at least one restraint mounted to a first engine component, wherein the at least one restraint is disposed near an outer perimeter of at least one sprocket attached to a second engine component, wherein the at least one restraint is capable of engaging a drive chain between the at least one sprocket and the restraint to prevent the drive chain from dislodging from the at least one sprocket while allowing the drive chain to move freely during engine operation, and wherein a distance between the outer perimeter of the at least one sprocket and the restraint limits movement of the drive chain relative to the sprocket such that the drive chain is engaged with the sprocket, and wherein at least one restraint attaches to an oil pump of the engine.

3. The drive chain assembly restraint of claim 2, wherein at least one restraint attaches to a backplate of the oil pump.

4. A drive chain assembly restraint, comprising:

a sprocket attached to a crankshaft that is mounted in an engine;

a drive chain engaged with the sprocket; and an engine component having at least one restraint such that, when the engine component is mounted on the engine, the restraint is disposed near an outer perimeter of the sprocket limits movement of the drive chain such that the drive chain remains engaged with the sprocket during movement of the engine, wherein the sprocket comprises a plurality of teeth along the outer perimeter of the sprocket, and wherein a distance between the teeth and the restraint limits movement of the drive chain relative to the sprocket such that the drive chain is engaged with the sprocket, and wherein at least one restraint is attached to an oil pump having a backplate.

5. A drive chain assembly restraint, comprising:

a sprocket attached to a crankshaft that is mounted in an engine;

a drive chain engagoed with the sprocket; and an engine component having at least on restraint such that, when the engine component is mounted on the engine, the restraint is disposed near an outer perimeter of the sprocket limits movement of the drive ive chain such that drive chyain remains engaged with the sprocket duringt movement of the engine, wherein the sprocket comprises a plurality of teeth along the outer perimeter of the sprocket, and wherein a distance between the teeth and the restraint limits movement of the drive chain relative to the sprocket such that the drive chain is engaged with the sprocket, and wherein the at least one restraint has no moving parts and passively engages the drive chain.

* * * * *